United States Patent [19]

Springer

[11] 4,267,811

[45] May 19, 1981

[54] CYLINDER HEAD FOR A MIXTURE-COMPRESSING INTERNAL COMBUSTION ENGINE

[75] Inventor: Willi Springer, Göppingen, Fed. Rep. of Germany

[73] Assignee: Daimler-Benz Aktiengesellschaft, Stuttgart, Fed. Rep. of Germany

[21] Appl. No.: 15,616

[22] Filed: Feb. 27, 1979

[30] Foreign Application Priority Data

Mar. 3, 1978 [DE] Fed. Rep. of Germany ..... 2809157

[51] Int. Cl.[3] ..... F02B 15/00; F01L 1/02

[52] U.S. Cl. ..... 123/432; 123/193 H; 123/90.27

[58] Field of Search ..... 123/191 R, 193 H, 188 M, 123/75 B, 90.27, 90.44, 432

[56] References Cited

U.S. PATENT DOCUMENTS

| | | | |
|---|---|---|---|
| 2,070,806 | 2/1967 | Read | 123/90.27 |
| 3,139,870 | 7/1964 | Sampietro | 123/90.27 |
| 3,219,019 | 11/1965 | Palmer | 123/191 M |
| 3,299,871 | 1/1967 | Apfelbeck | 123/188 M |
| 3,531,234 | 9/1970 | Ravenel | 123/193 H |
| 3,738,338 | 6/1973 | Wickman | 123/90.27 |

FOREIGN PATENT DOCUMENTS

| | | | |
|---|---|---|---|
| 2363637 | 4/1975 | Fed. Rep. of Germany | 123/191 R |
| 1256401 | 12/1971 | United Kingdom | 123/191 R |

*Primary Examiner*—Craig R. Feinberg
*Attorney, Agent, or Firm*—Craig and Antonelli

[57] ABSTRACT

A cylinder head for a mixture-compressing internal combustion engine with relatively small cylinder diameter, with a V-arrangement of two inlet valves and two exhaust valves each, which are actuated from a centrally arranged cam shaft by way of rocker arms; each rocker arm provided for the actuation of an inlet valve or each rocker arm provided for the actuation of an exhaust valve is supported overhung or all rocker arms are supported centrally while the spark plug is so arranged that the center longitudinal axis through the spark plug extends approximately parallel to the inlet valves or exhaust valves between the same and the cam shaft.

5 Claims, 5 Drawing Figures

CYLINDER HEAD FOR A MIXTURE-COMPRESSING INTERNAL COMBUSTION ENGINE

The present invention relates to a cylinder head for a mixture-compressing internal combustion engine with a relatively small cylinder diameter, with a V-arrangement of two inlet valves each and two outlet valves each which are actuated by way of rocker arms from a centrally arranged cam shaft.

The arrangement of a central cam shaft for the actuation of the inlet valves as also of the exhaust valves, in addition to a structural simplification, offers the advantage compared to the arrangement of two cam shafts that the cam shaft can be arranged inside of the V-arrangement of the valves so that the cylinder head can be constructed relatively low. However, disadvantageous with this arrangement is the fact that the spark plug cannot be arranged centrally in the interest of a favorable spark plug scavenging and short flame paths. A cylinder head is disclosed in the German Offenlegungsschrift No. 2,056,150 in which a single cam shaft is provided for the actuation of four valves and the spark plug is arranged centrally, but in which the advantage of the central spark plug position is lessened in that the cam shaft is arranged above one valve row in a position unfavorable for vertical in-line engines by reason of the structural height in such a manner that the valves of this valve row are actuated directly by the cams of the cam shaft and the other valves are actuated by way of rocker arms.

In contrast thereto, the present invention is concerned with the task to achieve for internal combustion engines having small cylinder diameters, a central arrangement of the spark plug with good accessibility notwithstanding the arrangement of a central cam shaft disposed inside of the V-arrangement of the valves.

The underlying problems are solved according to the present invention in that each rocker arm provided for the actuation of an inlet valve or each rocker arm provided for the actuation of an exhaust valve is mounted in an overhung manner or all of the rocker arms are mounted centrally, and in that the spark plug is so arranged with a central mouth of the spark plug bore within the combustion space that the center longitudinal axis extends through the spark plug parallel or approximately parallel to the inlet valves or the exhaust valves between the same and the cam shaft.

A space is created between the valves and the cam shaft by the overhung or central bearing support of the rocker arms actuating the valves, which makes possible the arrangement of a readily accessible spark plug recess and in extension thereto, of a spark plug pipe shielding the spark plug against the space underneath the cylinder head hood.

With an arrangement of four cams on the cam shaft, the cams for the actuation of those valves, with respect to which the center longitudinal axis through the spark plug is arranged in parallel, may be disposed on both sides of the cams for the actuation of the other valves so that also with a compact position of the cams on the cam shaft, sufficient space remains for the spark plug arrangement.

If only two cams are provided on the cam shaft, of which each actuates an exhaust as also an inlet valve, then each cam may be disposed spaced from the other adjacent a bearing for the cam shaft so that space is created advantageously for the spark plug arrangement.

Accordingly, it is an object of the present invention to provide a cylinder head for a mixture-compressing internal combustion engine which avoids by simple means the aforementioned shortcomings and drawbacks encountered in the prior art.

Another object of the present invention resides in a cylinder head for a mixture-compressing internal combustion engine which permits an arrangement of the cam shaft inside of the V-arrangement of the valves yet permits also a central arrangement of the spark plug.

A further object of the present invention resides in a cylinder head for a mixture-compressing internal combustion engine of the V-type which permits a favorable spark plug scavenging and short flame paths together with a low design and construction of the cylinder head.

A still further object of the present invention resides in a cylinder head for a mixture-compressing internal combustion engine having small cylinder diameters which enables a central arrangement of the spark plug with good accessibility notwithstanding a central arrangement of the cam shaft disposed inside of the V-arrangement of the valves.

These and other objects, features and advantages of the present invention will become more apparent from the following description when taken in connection with the accompanying drawing which shows, for purposes of illustration only, several embodiments in accordance with the present invention, and wherein.

Figure 1:
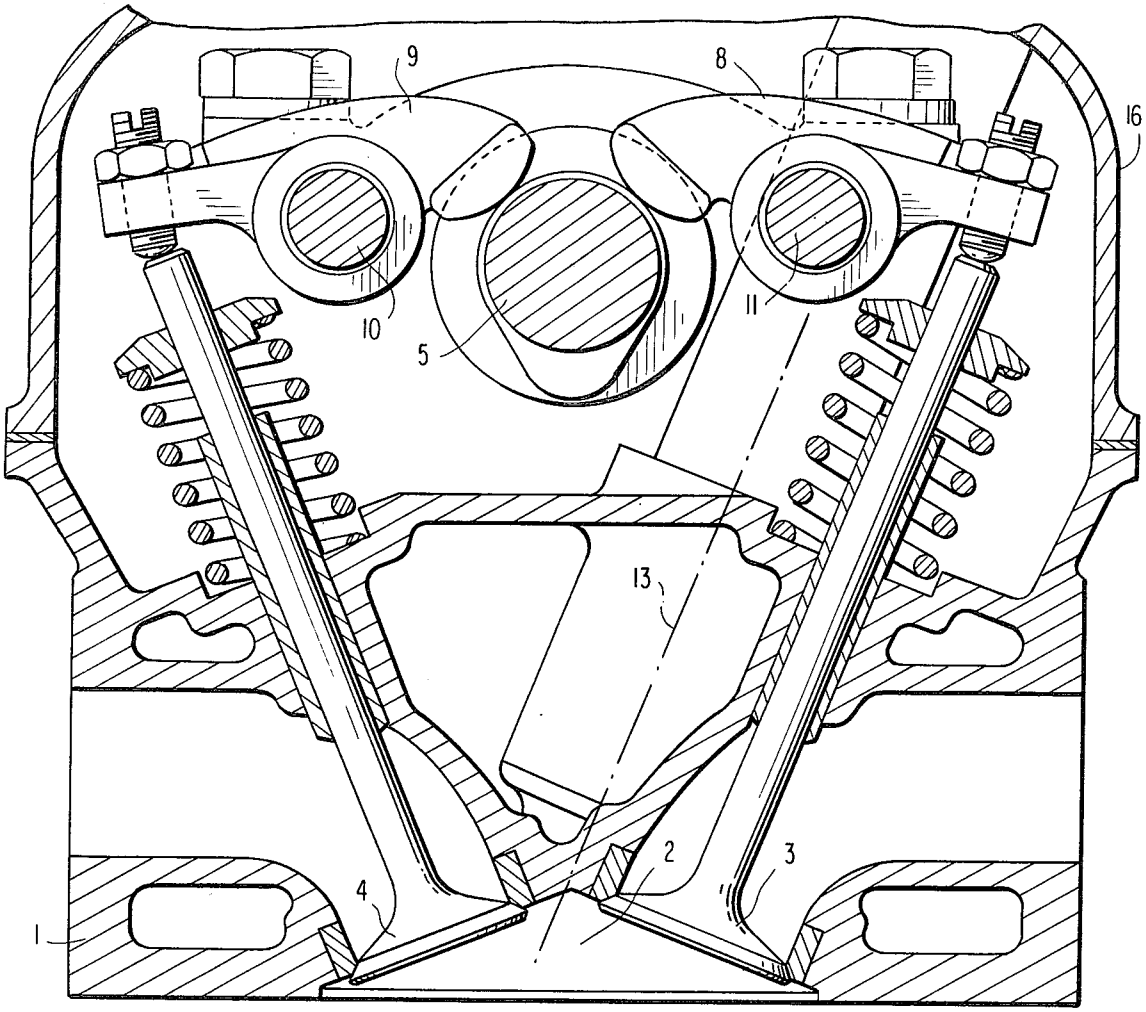
FIG. 1 is a longitudinal cross-sectional view through a cylinder head in accordance with the present invention.
Figure 2:
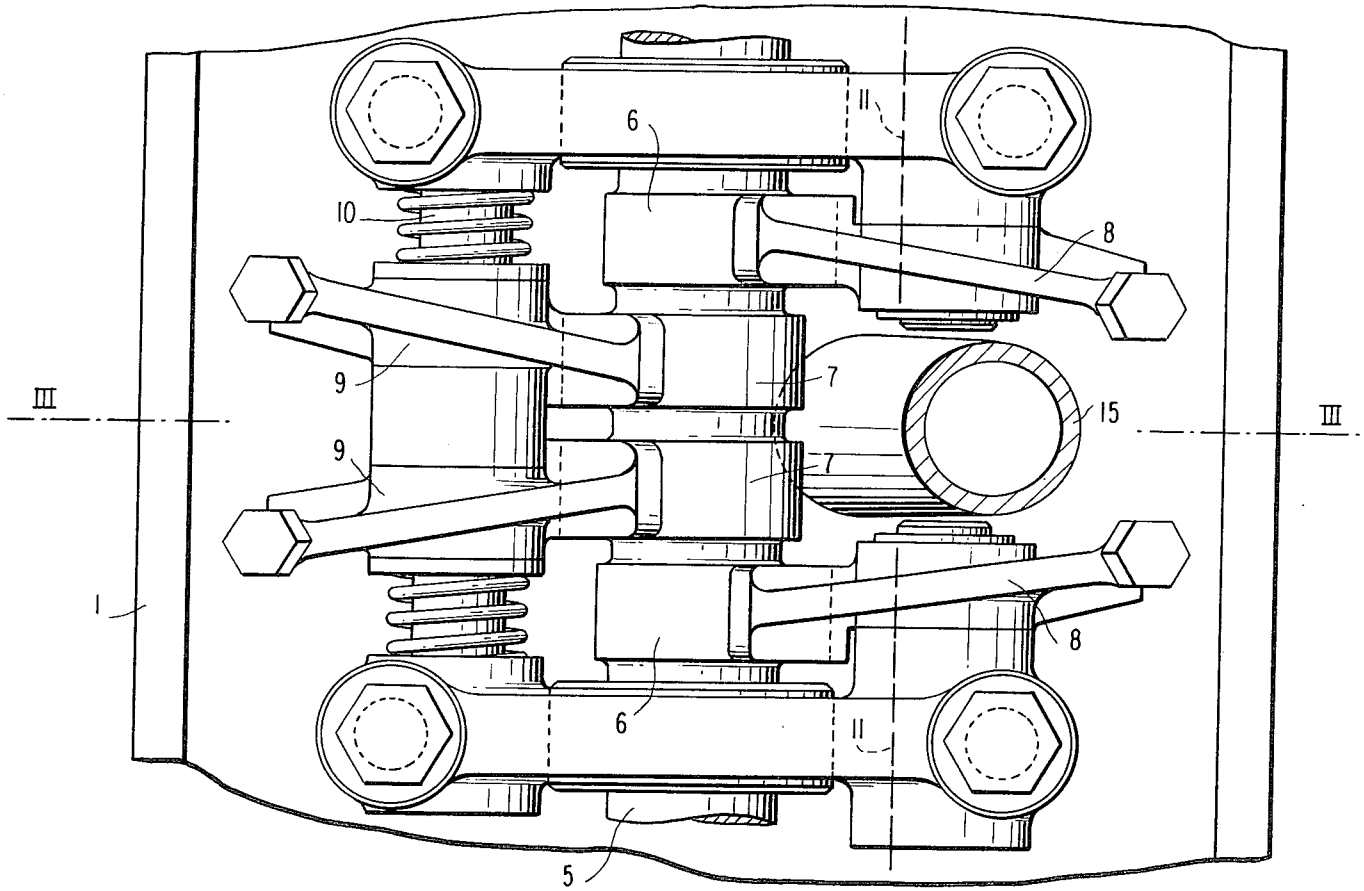
FIG. 2 is a plan view on the cylinder head according to FIG. 1.
Figure 3:
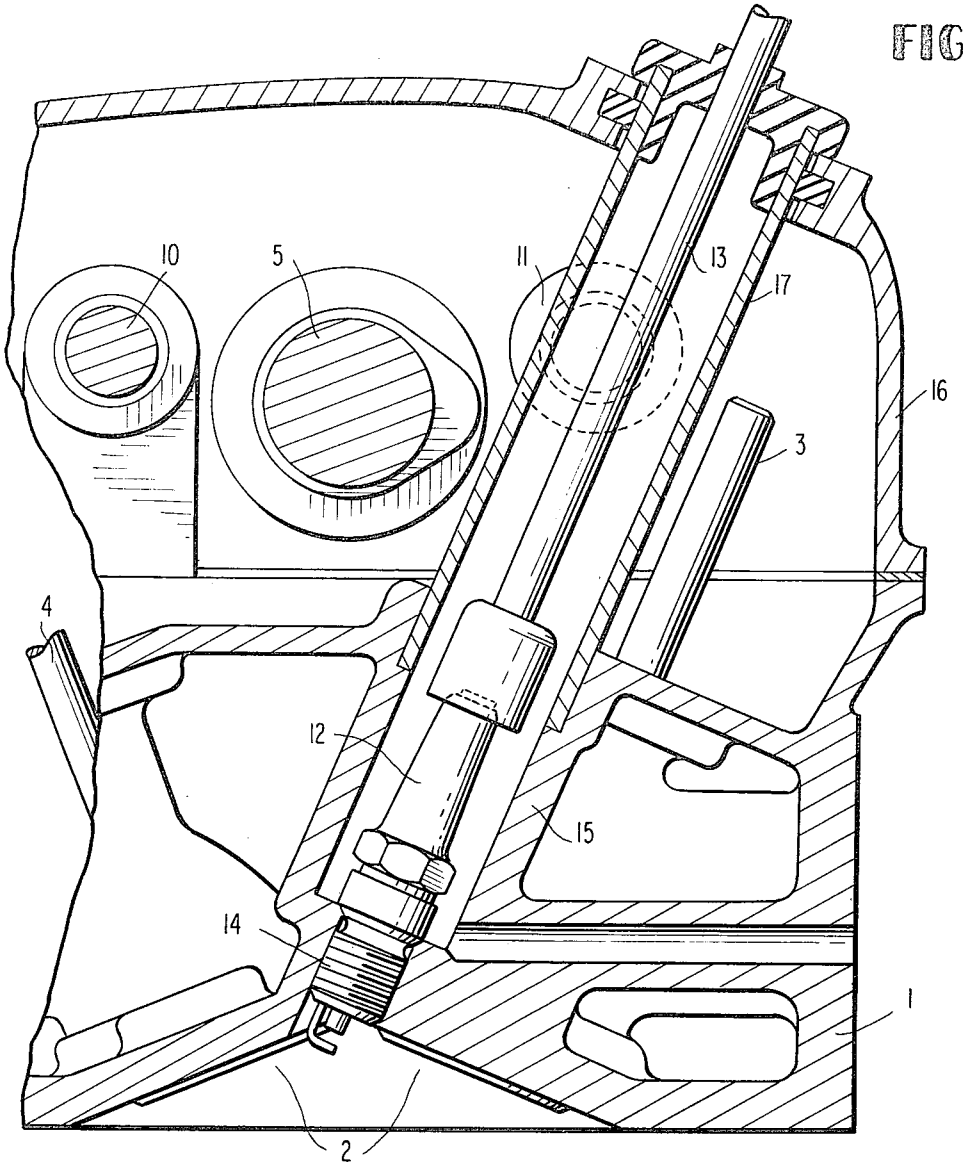
FIG. 3 is a longitudinal cross-sectional view through the cylinder head, taken along line III—III of FIG. 2.

Referring now to the drawing wherein like reference numerals are used throughout the various views to designate like parts, and more particularly to FIGS. 1 to 3, according to these figures, a roof-shaped combustion space 2 is provided in the cylinder head 1 for a mixture-compressing internal combustion engine. Two inlet valves 3 and two exhaust valves 4 in a V-arrangement serve for the gas-exchange in the combustion space 2. The control of the valves 3 and 4 takes place from a cam shaft 5, which is centrally arranged in the V-arrangement of the valves and includes inlet cams 6 and exhaust cams 7, by way of rocker arms 8 which cooperate with the inlet valves 3 and by way of rocker arms 9 which cooperate with the exhaust valves 4. The arrangement of the cams on the cam shaft 5 is made in such a manner that the exhaust cams 7 are disposed between the inlet cams 6. Whereas the rocker arms 9 for the exhaust valves 4 are supported in the cylinder head 1 on a common shaft 10, the rocker arms 8 for the inlet valves 3 are supported in an overhung manner each by itself on shafts 11. As a result of this overhung bearing support and by reason of the fact that the exhaust cams 7 on the cam shaft 5 are disposed between the inlet cams 6, space is gained between the two inlet valves 3 and the cam shaft 5 for a central arrangement of the spark plug 12 (FIG. 3). The center longitudinal axis 13 through the spark plug 12 extends parallel to the inlet valves 3. The spark plug bore 14 terminates centrally in the combustion space 2 of the cylinder head 1. The spark plug 12 is disposed in a spark plug recess 15 which is closed off in the direction toward the cylinder head hood 16 by a spark plug pipe 17 (FIG. 3).

Figure 4:
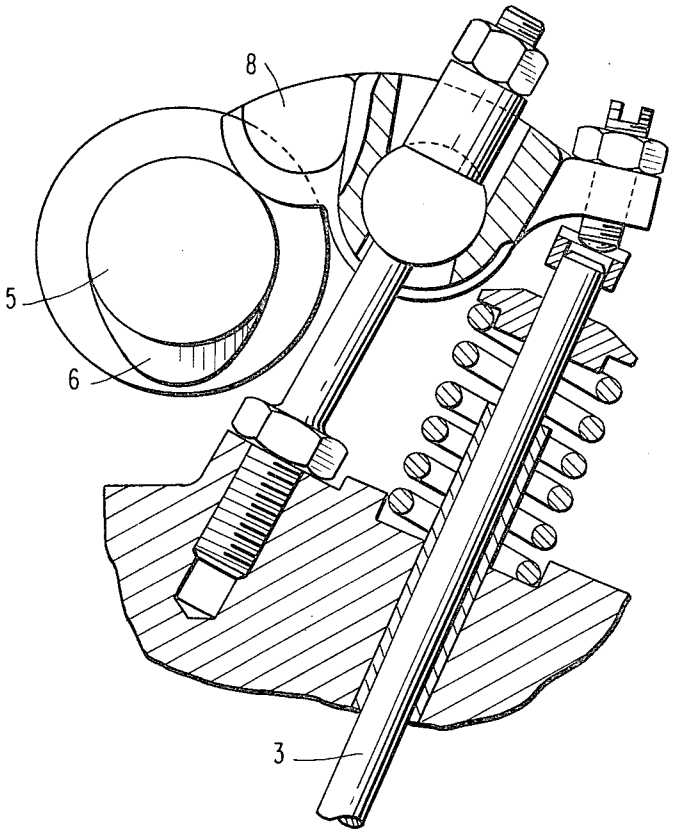
FIG. 4 is a partial cross-sectional view illustrating a central bearing support for a rocker arm in accordance with the present invention.

In lieu of an overhung bearing support for the rocker arms according to FIGS. 1 to 3, also a central bearing support may be provided therefor according to FIG. 4, and more particularly for all valves.

Figure 5:
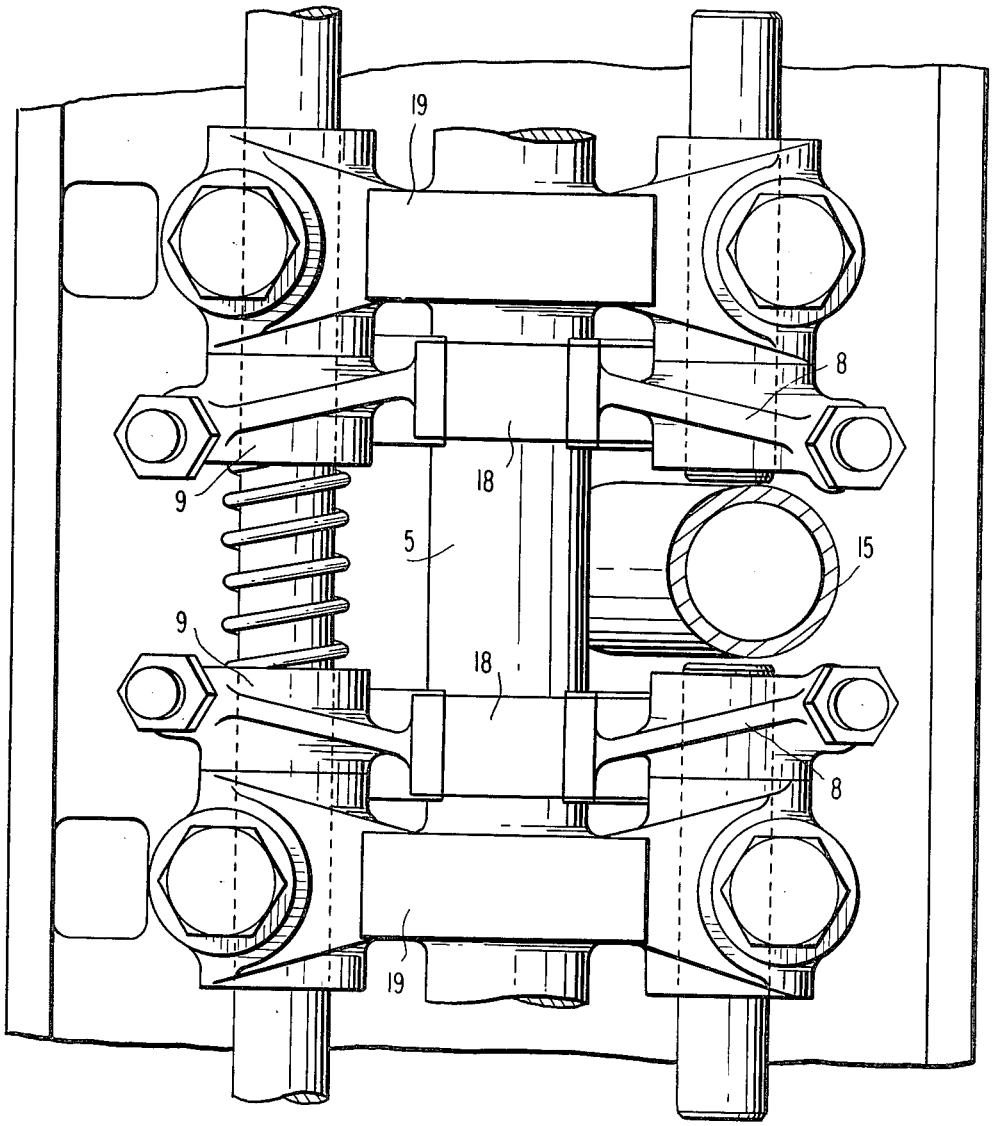
FIG. 5 is a plan view corresponding to FIG. 2, on a modified arrangement of a cam shaft having two cams in accordance with the present invention.

In the embodiment according to FIG. 5, one common cam 18 each is provided on the cam shaft 5 for the rocker arms 8 actuating the inlet valves and for the rocker arms 9 actuating the exhaust valves. The cams 18 are disposed spaced from one another adjacent the cam shaft bearings 19 in such a manner that sufficient space remains between the rocker arms 8 and the cam shaft 5 for the arrangement of a central spark plug in the spark plug recess 15.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A cylinder head for a mixture-compressing internal combustion engine having a relatively small cylinder diameter, with a V-arrangement of two inlet valve means and of two exhaust valve means which are actuated by way of rocker arm means from a cam shaft means, comprising a single cam shaft extending with a longitudinal axis located between said valve means, characterized in that the rocker arm means are so supported that a spark plug having a substantially central orifice of its spark plug bore is so arranged in the combination chamber that the center longitudinal axis through the spark plug extends at least approximately parallel to one of said valve means in a plane normal to said cam shaft longitudinal axis, and further being located between said one valve means and the cam shaft means.

2. A cylinder head according to claim 1, characterized in that each rocker arm means provided for the actuation of one of inlet valve and exhaust valve means is supported in an overhung manner.

3. A cylinder head according to claim 1, characterized in that all rocker arm means are centrally supported.

4. A cylinder head according to claim 1, 2 or 3, characterized in that with an arrangement of four cam means on the cam shaft means, the cam means for the actuation of those valve means, with respect to which the center longitudinal axis of the spark plug is at least approximately parallel, are disposed on both sides of the cam means for the actuation of the other valve means.

5. A cylinder head according to claim 1, 2 or 3, characterized in that with an arrangement of two cam means, of which each actuates both an exhaust and also an inlet valve means, each cam means is disposed spaced from the other cam means adjacent a bearing for the cam shaft means.

* * * * *